US006371351B1

(12) United States Patent
Magnusson

(10) Patent No.: US 6,371,351 B1
(45) Date of Patent: Apr. 16, 2002

(54) STAPLER

(75) Inventor: Lars-Inge Magnusson, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 09/968,911

(22) Filed: Oct. 3, 2001

(30) Foreign Application Priority Data

Oct. 11, 2000 (SE) ..... 0003658-2

(51) Int. Cl.[7] ..... B25B 5/16

(52) U.S. Cl. ..... 227/119; 227/120; 227/131; 227/136

(58) Field of Search ..... 227/119, 120, 227/131, 136, 137, 138, 114, 107, 135

(56) References Cited

U.S. PATENT DOCUMENTS 3,009,156 A * 11/1961 Lerner ..... 227/136
4,588,121 A * 5/1986 Olesen ..... 227/135
4,770,334 A * 9/1988 Hoshi et al. ..... 227/120
5,273,199 A * 12/1993 Logtens ..... 227/120
5,560,529 A * 10/1996 Udagawa et al. ..... 227/131
6,050,471 A * 4/2000 Yagi ..... 227/119

* cited by examiner

*Primary Examiner*—Scott Smith
(74) *Attorney, Agent, or Firm*—Miles & Stockbridge P.C.

(57) ABSTRACT

A stapler comprises a removable cassette, which contains a strip of staple blanks, and an advancing mechanism, which is arranged to advance the strip and which, to this end, has a feeding plate, which engages one flat side of the strip. The advancing mechanism comprises elements, which are arranged to interact with the removable cassette to move the feeding plate, during an initial phase of the cassette's removal from the stapler, to a neutral position, in which it has been disengaged from the strip, and to move the feeding plate, during a final phase of the reinsertion of the cassette or the insertion of a similar cassette into the stapler, to an engagement position, in which it engages the strip.

3 Claims, 6 Drawing Sheets

STAPLER

FIELD OF THE INVENTION

The present invention relates to a stapler for driving staples into an object, such as a sheaf of papers, said stapler comprising a base, in which a cassette is removably inserted, said cassette containing wire-shaped staple blanks, which are juxtaposed and releasably interconnected to form a strip of staple blanks, the strip being partially exposed through an opening in the cassette, a reciprocable staple shaper, which is arranged to successively shape staple blanks from the strip into U-shaped staples, a reciprocable staple driver, which is arranged to successively drive the staples formed into an object, and an advancing mechanism, which is arranged to advance the strip step by step in the direction of the staple shaper and the staple driver and which, to this end, is movable back and forth in the advancing direction of the strip, said direction coinciding with the direction in which the cassette is removed from the base, and in the opposite direction thereof and which comprises a feeding plate, which engages one flat side of the strip through said opening in the cassette so as to slide across this flat side when the advancing mechanism is being moved in the direction opposite to the advancing direction and to advance the strip when the advancing mechanism is being moved in the advancing direction.

BACKGROUND ART

A prior-art cassette of the type described above is described in more detail in EP 0 636 058. This cassette includes the staple shaper and the staple driver. Thus, when the cassette is removed from the base of the stapler, these elements are also removed. In a stapler according to prior art, in which cassettes including staple shaper and staple driver are used, the cassette is inserted into the base of the stapler from the front, i.e. the direction of insertion is the opposite of the advancing direction of the strip of staple blanks in the stapler. In this case, the cassette is inserted by means of guide ribs on the base and guide lugs on the cassette along a linear path of insertion, which is located in such manner relative to the mechanism arranged to advance the staple blanks in the cassette that the insertion takes place without the staple blanks touching the feeding plate of the advancing mechanism. Each of the guide ribs has in its portion located at the very back of the base a recess, into which a corresponding guide lug on the cassette can be inserted. When the cassette has reached its position inserted in the base, these recesses allow it to be moved a short distance perpendicularly to the direction of insertion so as to be moved in the direction of the advancing mechanism so that the strip of staple blanks is caused to engage the feeding plate. The feeding plate is forwardly inclined at an angle, i.e. in the direction opposite to the direction of insertion of the cassette, thus making it necessary to insert the cassette in such a position that the strip of staple blanks will not come into contact with the feeding plate during the insertion of the cassette. The removal of the cassette from the base is less critical in this respect. However, when removing the cassette, the cassette must, before it can be pulled out, first be inclined or tilted in such manner that the guide lugs inserted into the recesses are removed from the recesses in the guide ribs. When the cassette is inclined in this way, there is a considerable risk, if the cassette is carelessly handled and for some reason removed before it is empty, of the staple blanks in the cassette coming into contact with the bending die, over which the staple blanks are bent during operation of the stapler, and thus being damaged. Because the passage in the base into which the cassette is inserted must be sufficiently large to allow the cassette to be inclined in this way, there is also a considerable risk of the cassette being held in a slightly inclined position while being inserted into the base. Again, the staple blanks risk coming into contact with the bending die, which may damage them.

SUMMARY OF THE INVENTION

The object of the present invention is therefore to provide a stapler, in which the above-related problems are eliminated or at least significantly reduced.

According to the invention, this object is achieved with a stapler, which is of the kind stated by way of introduction and characterized in that the advancing mechanism comprises means, which are arranged to interact with the cassette, which has been removably inserted into the base, so as to move the feeding plate, during an initial phase of the cassette's removal from the base, to a neutral position, in which it has been disengaged from the strip, and to move the feeding plate, during a final phase of the reinsertion of the cassette or the insertion of a similar cassette into the base, to an engagement position, in which it engages the strip of the cassette, that said means comprise a slide, which is movable back and forth in the advancing direction and the opposite direction thereof between a rear position and a first front position, the slide being spring-biased in the advancing direction so as to be moved, when the cassette is being removed from the base, to a second front position located a short distance ahead of the first front position, said means being arranged in such manner that the feeding plate is in its engagement position during the slide's movement back and forth between the rear position and the first front position, and that it is in its neutral position when the slide is in the second front position, the slide, in the second front position, protruding such a distance from the base that it is hit, in the final phase of the insertion of a cassette, by the cassette and pressed to the first front position.

In a preferred embodiment, the feeding plate is pivotally mounted on the slide about an axis perpendicular to the advancing direction, the feeding plate being pivotable between its engagement position and its neutral position, and said feeding plate being spring-biased towards its engagement position.

Said means preferably comprise a ramp means, which is fixedly arranged in the base and located in such manner that the feeding plate, during the movement of the slide from the first front position to the second front position, hits the ramp means and is pivoted thereby from its engagement position to its neutral position.

BRIEF DESCRIPTION OF THE DRAWINGS

The invention will now be described in more detail with reference to the accompanying drawings, in which.

DESCRIPTION OF A PREFERRED EMBODIMENT

Figure 1:
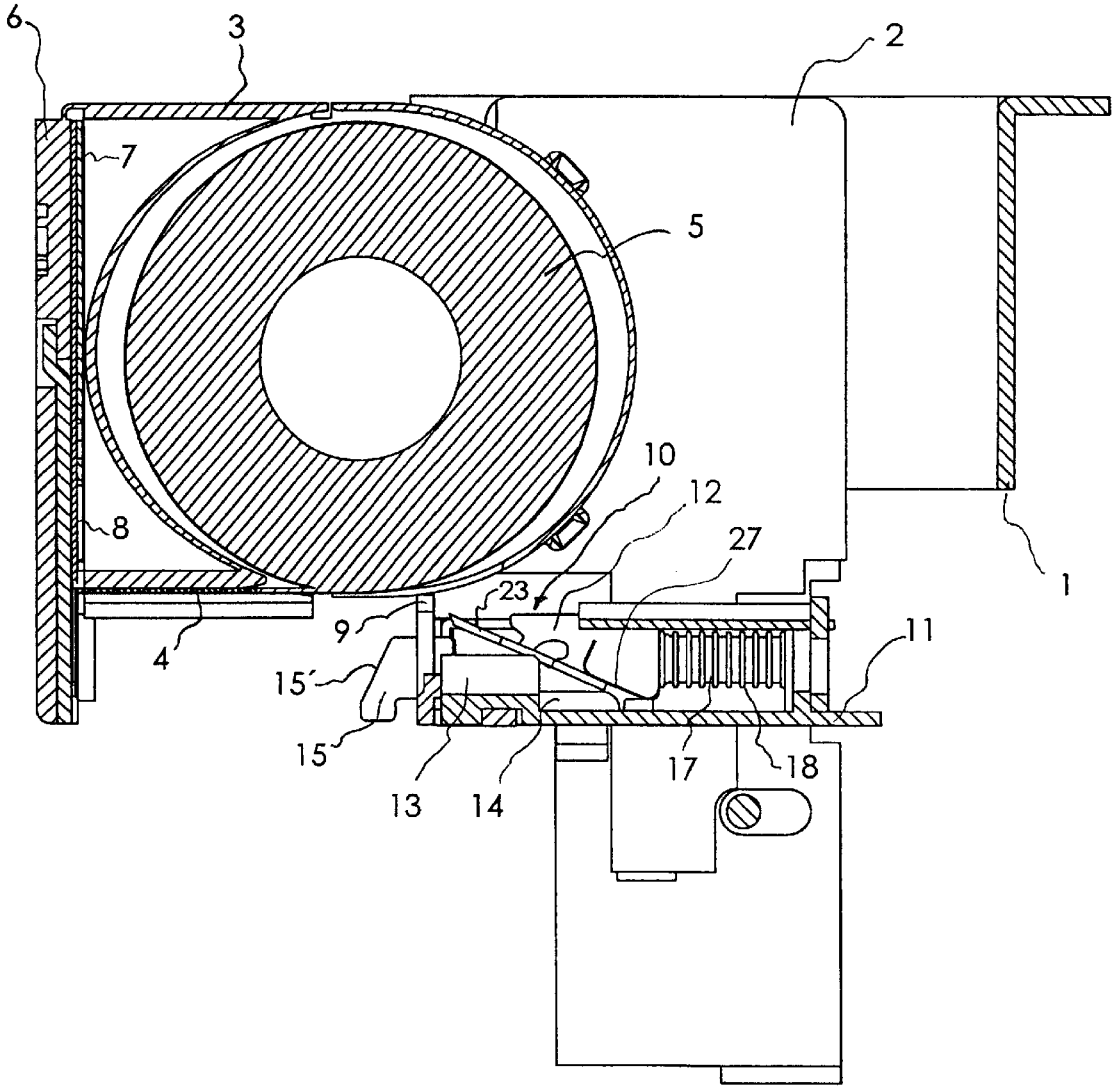
FIGS. 1–3 are sectional views showing a portion of a stapler according to the invention, in which a cassette insertable into the stapler is shown in three different positions of insertion.
Figure 2:
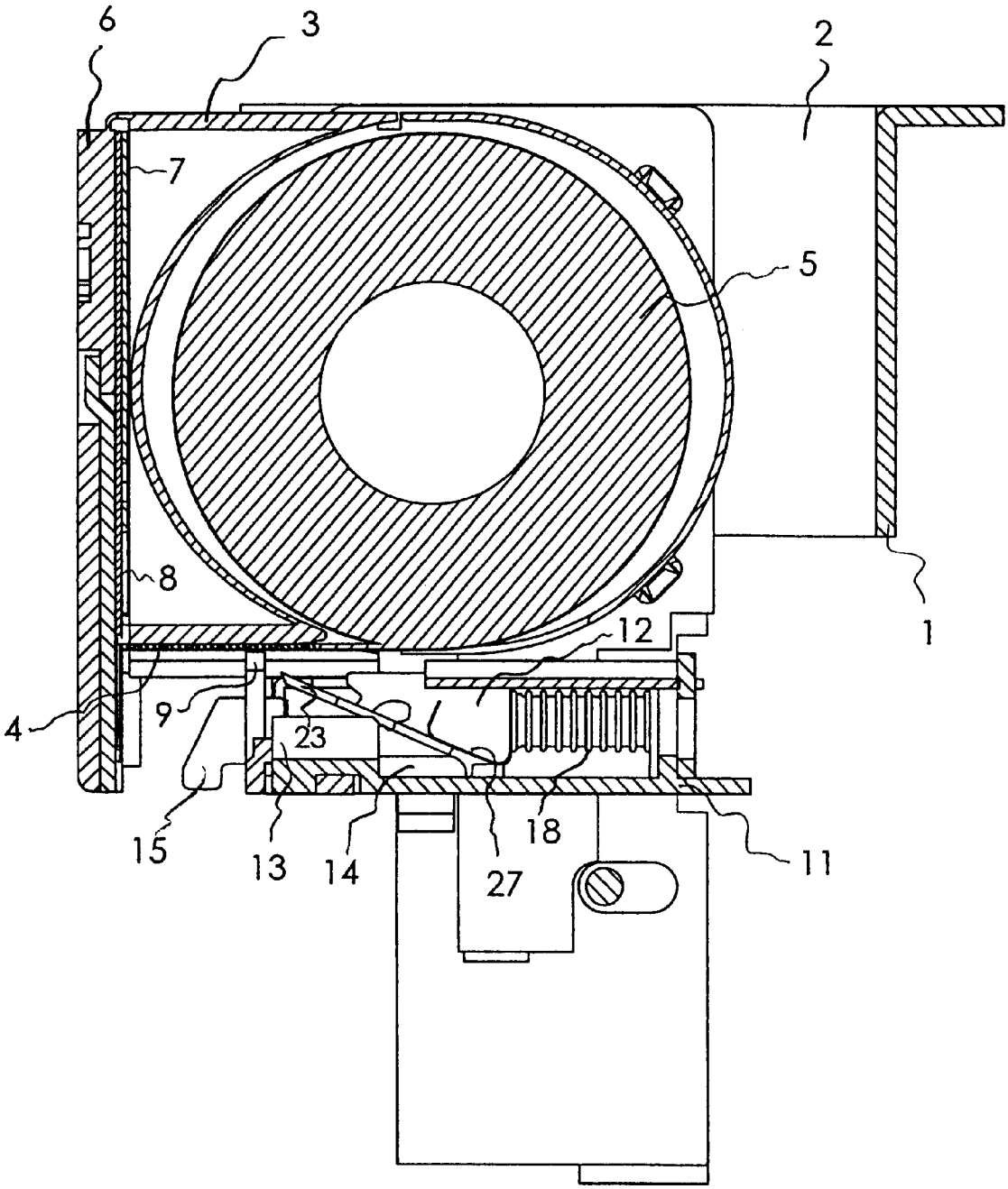
Figure 3:
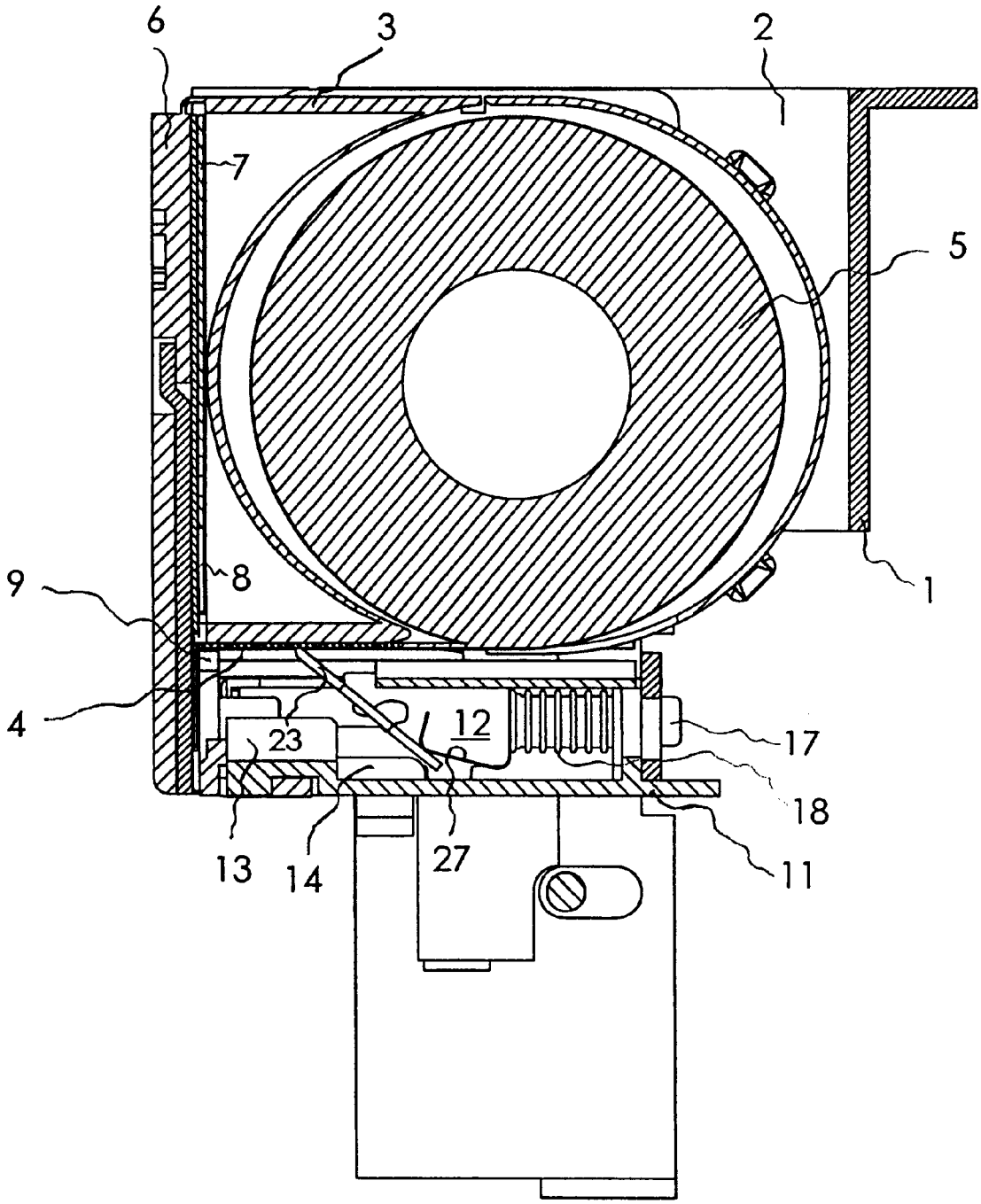
Figure 4:
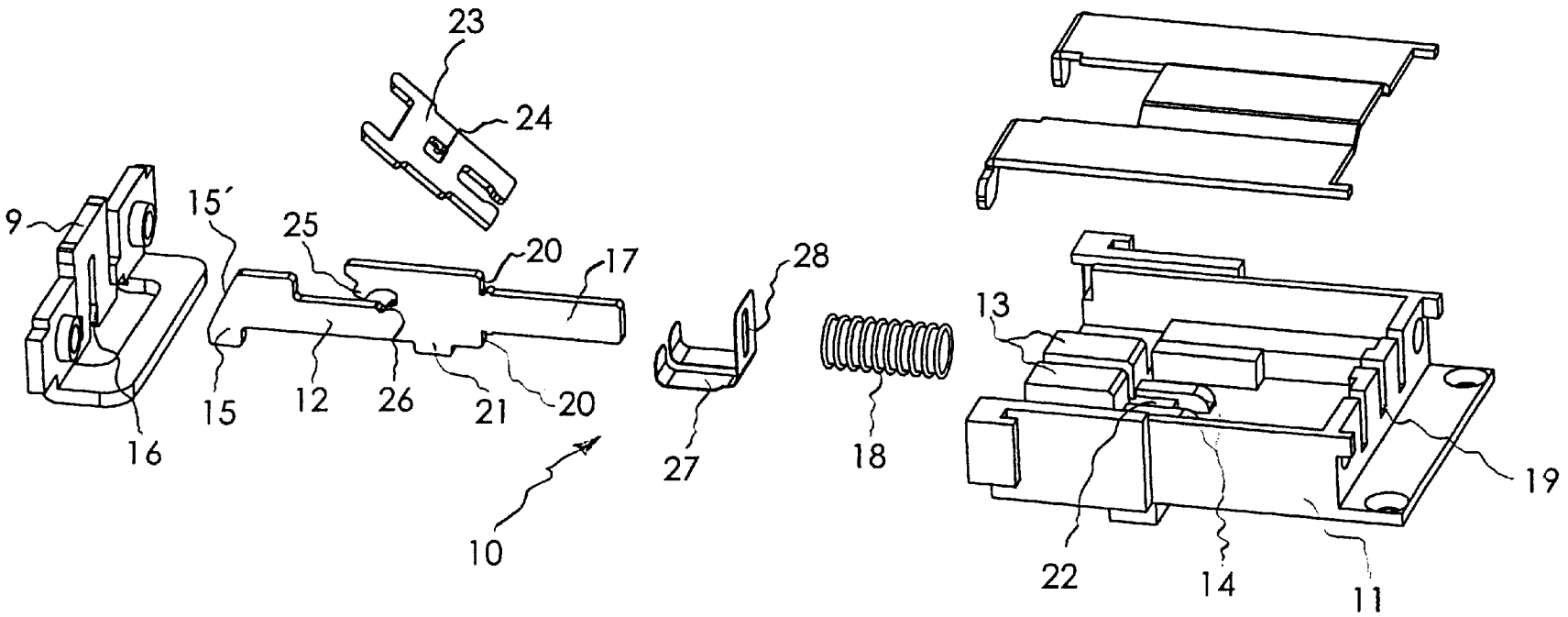
FIG. 4 is an exploded view showing an advancing mechanism arranged in the stapler according to FIGS. 1–3.

The stapler of which a portion is shown in FIGS. 1–3 is electrically operated and has a fixed base 1 comprising an insertion passage 2 in its front part, i.e. in the part located to the left in FIGS. 1–3. A cassette 3 is insertable into the passage 2. In FIG. 1, the cassette 3 is shown in a first position, in which it is inserted only a short distance into the passage, in FIG. 2 it is shown in a second position, in which it is inserted a significantly longer distance, and in FIG. 3 it is shown in a third position, in which it is completely inserted.

The cassette 3 contains straight, wire-shaped staple blanks, which are juxtaposed and releasably interconnected, for example by means of adhesive tape, to form a strip 4 of staple blanks, which is rolled up into a roll 5. The strip 4 extends out of the cassette 3 and is accessible from underneath through an opening in the front part of the underside of the cassette. The cassette 3, which is of the type described in the above-mentioned EP 0 636 058, has a front piece 6, in which a staple shaper 7 and a staple driver 8 are vertically reciprocatingly arranged. The staple shaper 7 and the staple driver 8, which in FIGS. 1–3 are shown in their upper turning position, can be caused to reciprocate in prior-art manner by means of a common drive mechanism (not shown). The staple shaper 7 is arranged to interact with a bending die 9, over which the strip 4 of staple blanks is advanced step by step when the stapler is in use (see FIG. 3). The strip 4 is advanced by means of an advancing mechanism which will be described in more detail below. The staple shaper 7 is arranged to successively bend the staple blanks in the strip 4 over the bending die 9 and shape them into substantially U-shaped staples. The staple driver 8 is arranged to successively release the formed staples from the strip 4 and drive them into an object, for example a sheaf of papers.

The above advancing mechanism 10 is arranged in a box-type housing 11, on the front wall of which the bending die 9 is formed. The housing 11 is attached to the base 1.

The advancing mechanism 10 has a slide 12, which is movable back and forth in the housing 11 and which has been punched from a piece of sheet metal. The slide 12 is arranged on its edge and located between two front guide lugs 13 and two rear guide lugs 14, which are formed on the bottom of the housing 11. The two rear guide lugs 14 have a rounded shape in their back portion so as to form a ramp means. The slide 12 has a front portion 15, which extends through a vertical slot 16 in the bending die 9, and which has an upwardly-forwardly facing front ramp surface 15', which is arranged to interact with the staple driver 8 in a way that will be described in more detail below. The rear portion 17 of the slide 12 extends through a pressure spring 18 and into a slot 19 in the rear wall of the housing 11. The spring 18 is restrained between the rear wall of the housing 11 and two lugs 20 on the slide 12. The spring 18 thus presses the slide 12 forward. When the cassette 3 is completely inserted into the base 1 (FIG. 3), the slide 12 is movable back and forth between a first front position (FIG. 3), in which its front portion 15 rests against the front piece 6 of the cassette 3, thereby extending into the path of motion of the staple driver 8, and in which the staple driver 8, during its downward movement, hits the ramp surface 15' of the front portion 15, moving the slide 12 backwards against the action of the spring 18, and a rear position, into which the slide 12 is thus moved by the staple driver 8. As the staple driver 8 is moved upwards during its reciprocating motion, the slide 12 is moved back to the first front position by the spring 18. If the cassette 3 is removed from the base 1 of the stapler, the spring 18 will press the slide further in the forward direction to a second front position (FIGS. 1 and 2), which is located a short distance ahead of the first front position and in which the front portion 15 of the slide 12 protrudes a short distance in front of the bending die 9. In this second front position, a stop lug 21 formed on the underside of the slide 12 abuts with its front edge against a rear edge of a corresponding stop lug 22, which is formed on the bottom of the housing 11 in the guide groove formed between the two rear guide lugs 14.

Figure 5:
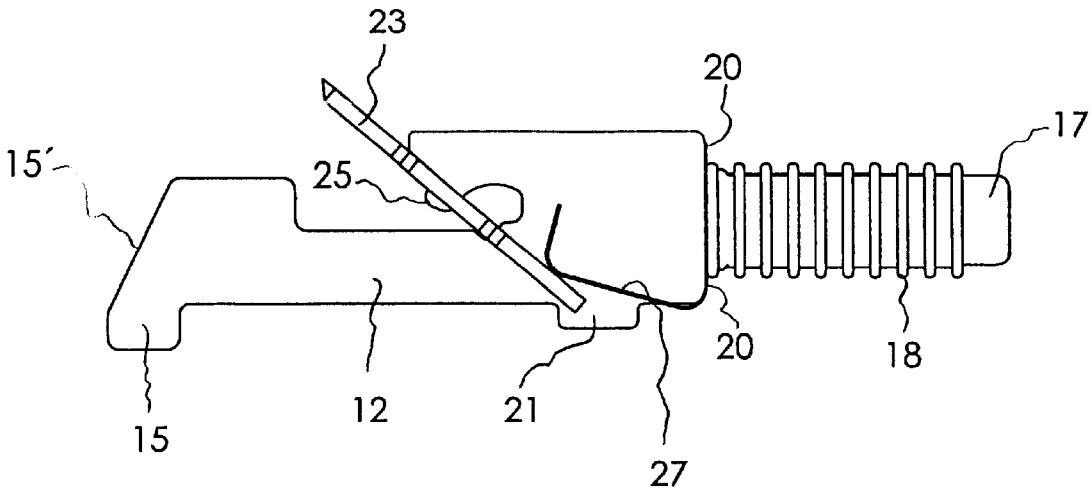
FIGS. 5–6 are side views showing elements included in the advancing mechanism in a first and a second position, respectively.
Figure 6:
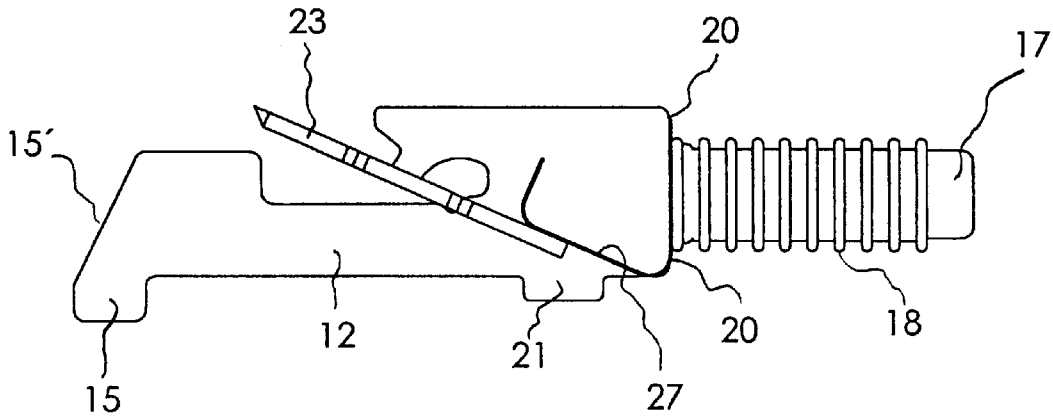
Figure 7:
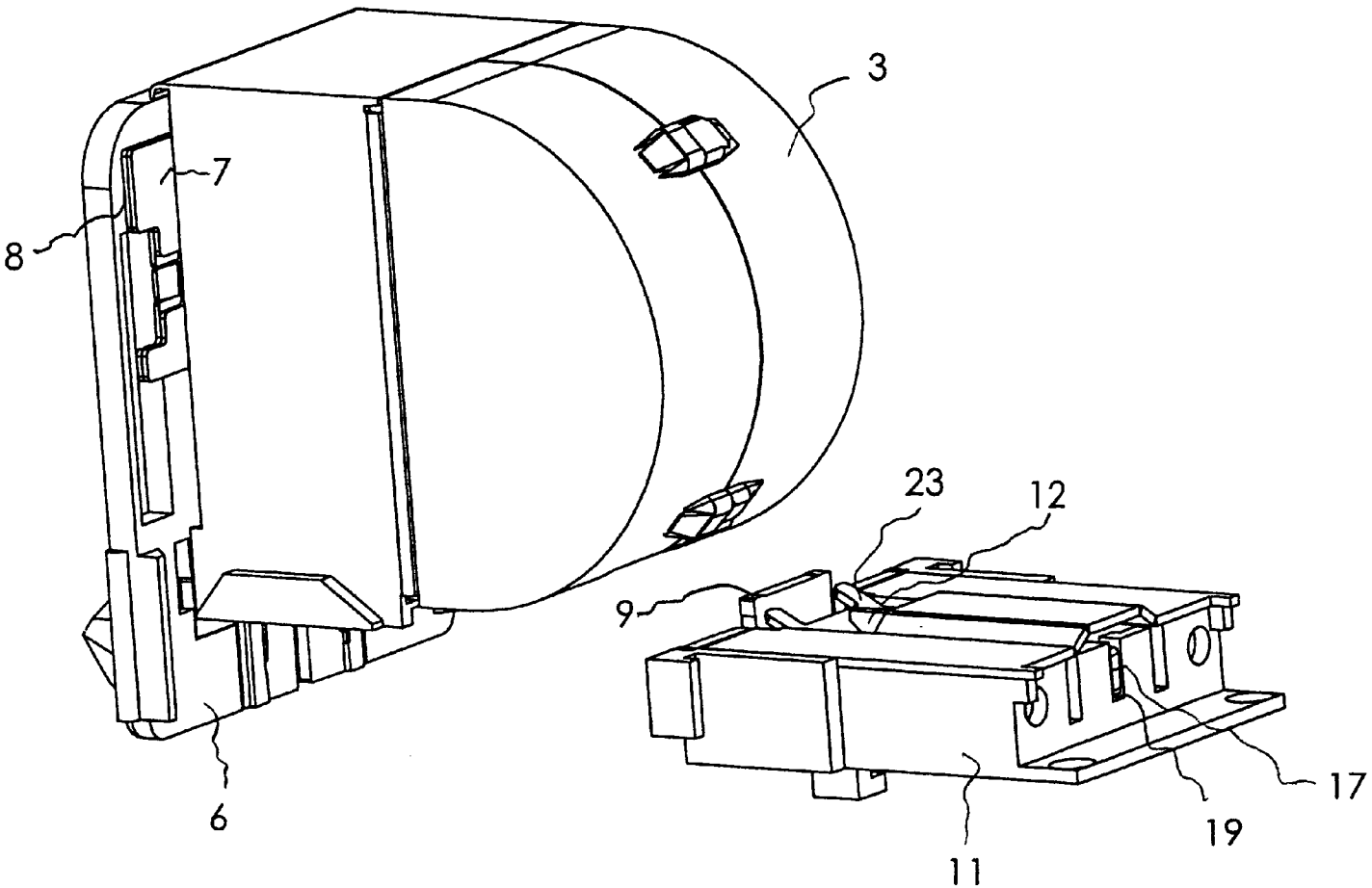
FIG. 7 is an exploded view showing the cassette and a housing, which contains the advancing mechanism.

The advancing mechanism 10 also has a substantially H-shaped feeding plate 23, which has a through hole 24 in its web portion. The two lower H-legs of the feeding plate 23 are arranged on either side of the slide 12, which has a projection 25 extending obliquely from above and from behind into the hole 24, and a recess 26, which is located slightly behind this projection and against the bottom of which the web portion of the feeding plate 23 rests. The feeding plate 23 is pivotable between a raised position or engagement position (FIGS. 3 and 5), in which its upper H-legs, with their pointed ends (see FIGS. 5 and 6), engage the underside of the staple strip 4 (see FIG. 3), and a lowered position or neutral position (FIGS. 1, 2, 6 and 7), in which these ends are located at a level slightly below the strip 4 and thus have been disengaged therefrom. The feeding plate 23 is spring-biased towards its raised position by means of a substantially orthogonally bent plate spring 27. The plate spring 27 has on the one hand a substantially vertical portion with a vertical slot 28 and, on the other hand, a substantially horizontal portion, which is substantially U-shaped. The rear portion 17 of the slide 12 extends through the slot 28 in the spring 27, the substantially vertical portion of the spring 27 abutting against the two lugs 20 on the slide 12 and its two U-legs being arranged on either side of the slide 12, and each being pressed against one of the two lower H-legs of the feeding plate 23 so as to press, as stated above, the feeding plate 23 towards its raised position.

When the cassette 3 is completely inserted into the base 1 of the stapler (FIG. 3), the slide 12 is in its first front position and the feeding plate 23 is in its raised position engaging the staple strip 4. As the staple driver 8, in its reciprocation cycle, is first moved downwards to drive the staple formed by the staple shaper 7 during the immediately preceding reciprocation cycle into an object, it interacts with the ramp surface 15' of the front portion 15 of the slide 12 to press, against the action of the pressure spring 18, the slide 12 backwards to its rear position. As the staple driver 8 is then moved upwards, the pressure spring 18 again advances the slide 12 to its first front position. As the slide 12 is pressed backwards, the feeding plate 23 is also moved backwards a distance, its upper H-legs abutting against the underside of the strip 4. As the slide 12 is again moved forwards, the feeding plate 23 advances the strip 4 one step, whereby the staple formed by the staple shaper 7 during this reciprocating motion is advanced to a position in the path of motion of the staple driver 8 and the next staple blank is advanced to a position in the path of motion of the staple shaper 7, i.e. to a position immediately above the bending die 9.

When the cassette 3 is removed from the base 1, its front piece 6 is immediately moved away from the front portion 15 of the slide 12, so that the pressure spring 18, in a initial phase of the removal of the cassette, moves the slide 12 forward from the first front position to the second front position. During this movement of the slide 12, the feeding plate 23 is entrained, whereby its lower H-legs, which are guided onto the guide lugs 14 via the ramp means formed of the rounded rear ends of the said lugs, are immediately pressed upwards by the guide lugs 14 against the action of the spring 27. The feeding plate 23 is thus pivoted from its raised position to its lowered position, in which the pointed ends of its upper H-legs are located a distance below the cassette 3. When cassette 3 is again inserted into the base 1 or a new similar cassette is inserted therein, the feeding plate is pivoted back to its raised position only in a final se of the insertion of the cassette, more specifically when the front piece 6 of the cassette hits the front portion 15 of the slide 12, thereby moving the de back to the first front position.

What I claim and desire to secure by Letters Patent is:

1. A stapler for driving staples into an object, such as a sheaf of papers, said stapler comprising a base (1), in which a cassette (3) is removably inserted, said cassette containing wire-shaped staple blanks, which are juxtaposed and releasably interconnected to form a strip (4) of staple blanks, the strip being partially exposed through an opening in the cassette, a reciprocable staple shaper (7), which is arranged to successively shape staple blanks from the strip into U-shaped staples, a reciprocable staple driver (8), which is arranged to successively drive the staples formed into an object, and an advancing mechanism (10), which is arranged to advance the strip step by step in the direction of the staple shaper and the staple driver and which, to this end, is movable back and forth in the advancing direction of the strip, said direction coinciding with the direction in which the cassette (3) is removed from the base (1), and in the opposite direction thereof and which comprises a feeding plate (23), which engages one flat side of the strip (4) through said opening in the cassette (3) so as to slide across this flat side when the advancing mechanism (10) is being moved in the direction opposite to the advancing direction and to advance the strip when the advancing mechanism is being moved in the advancing direction, characterized in that the advancing mechanism (10) comprises means (12, 14, 18, 27), which are arranged to interact with the cassette (3), which has been removably inserted into the base (1) so as to move the feeding plate (23), during an initial phase of the cassette's removal from the base, to a neutral position, in which it has been disengaged from the strip (4), and to move the feeding plate (23), during a final phase of the reinsertion of the cassette (3) or the insertion of a similar cassette into the base (1), to an engagement position, in which it engages the strip (4) of the cassette, that said means (12, 14, 18, 27) comprise a slide (12), which is movable back and forth in the advancing direction and the opposite direction thereof between a rear position and a first front position, that the slide (12) is spring-biased in the advancing direction so as to be moved, when the cassette (3) is being removed from the base (1), to a second front position located a short distance ahead of the first front position, that said means (12, 14, 18, 27) are arranged in such manner that the feeding plate (23) is in its engagement position during the slide's (12) movement back and forth between the rear position and the first front position and that it is in its neutral position when the slide (12) is in the second front position, and that the slide (12), in the second front position, protrudes such a distance from the base (1) that it is hit, in the final phase of the insertion of a cassette (3), by this cassette and pressed to the first front position.

2. A stapler according to claim 1, characterized in that the feeding plate (23) is pivotally mounted on the slide (12) about an axis perpendicular to the advancing direction, the feeding plate (23) being pivotable between its engagement position and its neutral position, and that the feeding plate is spring-biased towards its engagement position.

3. A stapler according to claim 2, characterized in that said means (12, 14, 18, 27) comprise a ramp means (14), which is fixedly arranged in the base (1) and located in such manner that the feeding plate (23), during the movement of the slide (12) from the first front position to the second front position, hits the ramp means (14) and is pivoted thereby from its engagement position to its neutral position.

* * * * *